United States Patent [19]

Seabourn

[11] 3,963,605

[45] June 15, 1976

[54] COATED SHAKER SCREEN APPARATUS AND METHOD

[75] Inventor: Ed O. Seabourn, Great Yarmouth, England

[73] Assignee: Phillips Petroleum Company, Bartlesville, Okla.

[22] Filed: Mar. 14, 1974

[21] Appl. No.: 451,024

[52] U.S. Cl. ..... 209/2; 209/233; 209/392; 260/900; 428/256

[51] Int. Cl.[2] ..... B03B 9/00

[58] Field of Search ..... 210/65, 506, 400, 507, 210/388; 209/397, 233, 401, 392, 2; 260/29.2, 29.6, 37, 79, 28.5, 900; 428/256; 162/DIG. 1

[56] References Cited

UNITED STATES PATENTS

| | | | |
|---|---|---|---|
| 599,468 | 2/1898 | Crass | 209/397 |
| 1,800,168 | 4/1931 | Brauer et al. | 209/2 |
| 1,961,232 | 6/1934 | Maust et al. | 209/2 |
| 3,315,804 | 4/1967 | Brauchla | 209/401 X |
| 3,354,129 | 11/1967 | Edmonds, Jr. | 260/79 |
| 3,573,089 | 3/1971 | Tate et al. | 162/DIG. 1 |
| 3,620,368 | 11/1971 | Comis et al. | 209/401 |
| 3,622,376 | 11/1971 | Tiezen | 260/900 |
| 3,728,313 | 4/1973 | Hill, Jr. et al. | 260/29.2 R |

OTHER PUBLICATIONS

Kirk–Othmer, Encycl. of Chem. Technology, vol. 9, p. 812–819, 2nd ed. Interscience, N.Y. 1966.

*Primary Examiner*—Theodore A. Granger

[57] ABSTRACT

A screen with a solid arylene sulfide polymer-polytetrafluoroethylene coating is provided that is suitable for use in a solids separating device. The poly(arylene sulfide)-polytetrafluoroethylene coating provides efficient passage of semi-solid or gummy material across the screen surface thereby reducing the chance of blinding the screen. Method of separating drilling mud.

6 Claims, 4 Drawing Figures

COATED SHAKER SCREEN APPARATUS AND METHOD

BACKGROUND OF THE INVENTION

Figure 1:
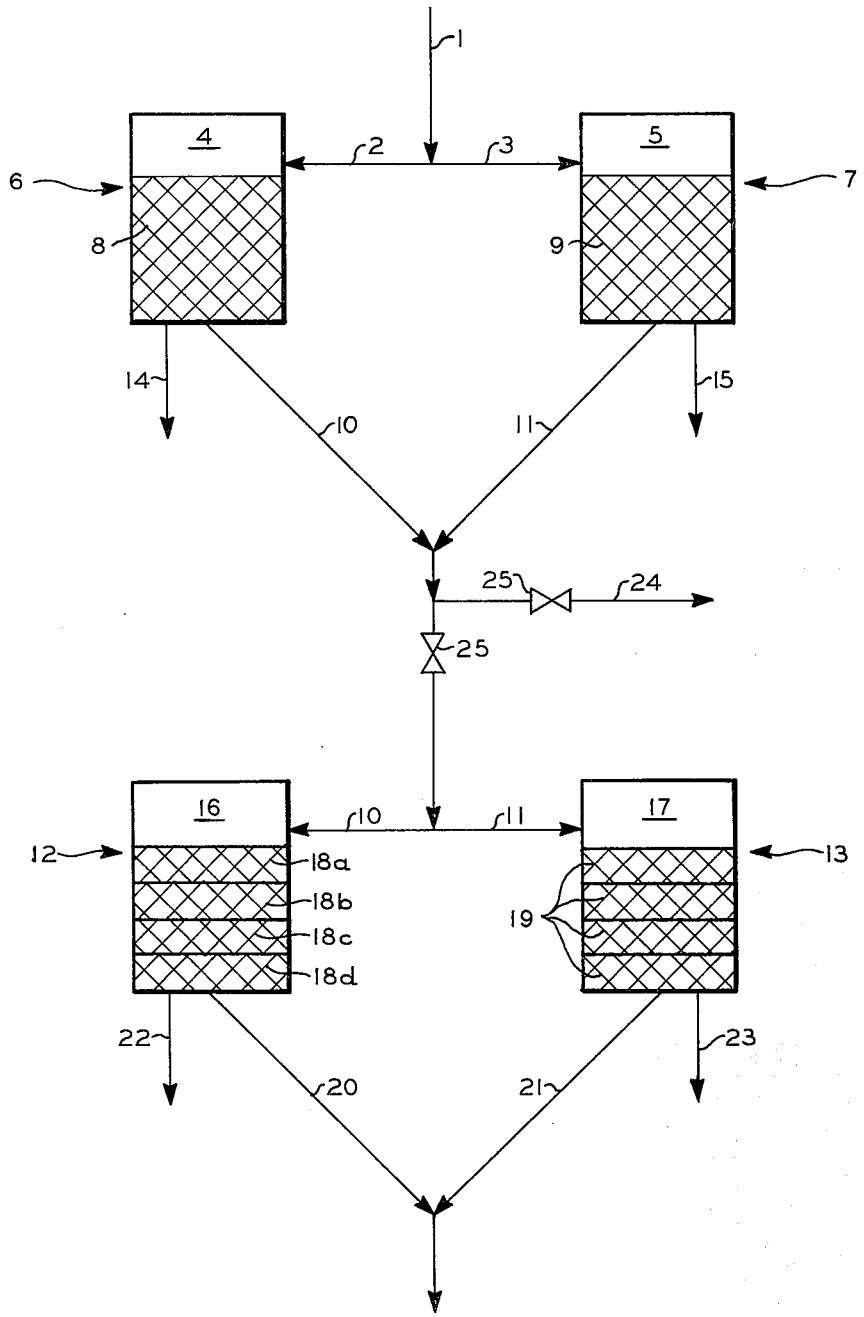

This invention relates to screens for separating solid particles from fluids or fluid slurries. In one of its aspects this invention relates to coatings for separating screens. In another of its aspects this invention relates to the separation of "gummy" material and larger solid particles from a fluid stream.

In one of its concepts this invention relates to the method of separation of larger solid particles and gummy material from circulating drilling mud by a separator screen coated with a coating to which the gummy material does not easily adhere, thereby allowing the gummy material to pass across the screen with the larger solid particles.

The art of separating solid particles from fluid streams by passing a fluid through a screening device having perforations of such size that solid particles are retained on the screen surface instead of passing through is well known. In some processes it is not simply a matter of passing solid particles carried in a fluid stream across a screening device to obtain a separation. Some fluid streams contain additional materials that cause solid particles to adhere to each other or to the screen surface ultimately bridging the openings in the screen and blinding the screen surface. Such a problem is frequently encountered in the drilling of wells during which operation a drilling mud is circulated into the drill hole. The mud carries drilling cuttings back to the surface where the cuttings are separated from the drilling mud before the mud is recirculated to the drilling operation.

Frequently in drilling operations a gummy clay formation is encountered which makes the separation of drilling cuttings from the drilling liquid by screening operations very difficult. The gummy clay, sometimes called gumbo, adheres to metal surfaces causing a buildup on the metal screen which can blind the screens so that fluid material for separation passes over the screen side instead of through the screen. I have discovered that coating a metal screen, including both the perforated surface and the screen support, with a polymeric substance that forms a "slick" surface alleviates the problems sufficiently to prevent the blinding of the screen and the consequential overflow of the screen.

It is therefore an object of this invention to provide an efficient means for separating drilling solids and gummy mud from drilling liquids. It is another object of this invention to provide a shaker screen coated with polymeric coating of sufficient surface slickness to retard adherence of gummy substances to the screen.

Other aspects, objects and the advantages of this invention will be apparent to one skilled in the art upon studying the specification, drawing and the appended claims.

SUMMARY OF THE INVENTION

In accordance with this invention a screen is provided comprising a metallic screen base coated with a mixture of solid arylene sulfide polymer and polytetrafluoroethylene. This coated screen is suitable for use in a shaker apparatus to prevent gummy mud from drilling operations from adhering to the screening means.

The material suitable for constructing the base plates and screens in any metal commonly used in producing wire or screening, expanded metal, or plate. Among those most commonly used are iron, various steels, aluminum, brass, copper and the like.

The base plates can be perforated metal, expanded metal, or various types of woven element screens. Screens having a large open area to solid area ratio may require reinforcement at the rim of the screen. To attain a screen that will not pass a particle of a certain size, the plates must be constructed with openings of sufficient size to allow for the ultimate thickness of the coating material. In general sufficient opening should be made in the base plates to allow for a coating of about 0.0015 to about 0.006 inches which is sufficient to give adequate wear but not so thick as to cause excessive mechanical problems. It is well within the skill of the art to fashion screens as described above to fit shaker apparatus of commercial design.

Characteristics necessary for a coating material suitable for use in the process of this invention are: processability into a smooth coating, adhesion of the coating to a metal surface, and resistance of the surface of the applied coating to a metal surface, and resistance of the surface of the applied coating to adherence of contacting materials, this last characteristic is herein described as "slickness." Polytetrafluoroethylene and solid arylene sulfide polymers meet the requirements and are therefore suitable for use in this invention. Suitable solid arylene sulfide polymers can be produced by the method set forth in U.S. Pat. No. 3,354,129 and suitable polytetrafluoroethylene can be produced as set forth in U.S. Pat. No. 2,559,752 or 2,612,484.

Method for coating metal substrates with solid arylene sulfide polymer and polytetrafluoroethylene are known to the art. One method for coating a substrate with solid arylene sulfide polymer is set forth in U.S. Pat. No. 3,728,313. A method for coating a substrate with polytetrafluoroethylene is set forth in Kirk-Othmer, Encyclopedia of Chemical Technology, Second Edition, Volume 9, Interscience, New York 1966, pages 815–817.

Particularly preferred for a coating material is a mixture of arylene sulfide polymer and polytetrafluoroethylene which is prepared by milling Ryton(R) polyarylene sulfide polymer Grade V-1, a product of Phillips Petroleum Company which has a 545°F. melting point, 600°F. melt flow of about 6000 grams per 10 minutes (using a 5 kilogram weight, procedure based on ASTM D-1238 Procedure B) and inherent viscosity of about 0.16 decaliters per gram (measured at 206°C. in 1-chloronaphthalene). The milled polymer is blended with polytetrafluoroethylene which has been slurried in water. Polytetrafluoroethylene water slurry is available from E. I. du Pont de Nemours and Company, Wilmington, Delaware. The blend contains 99 to 25 percent by weight poly(arylene sulfide) and 1 to 75 percent by weight polytetrafluoroethylene, preferably 95 to 70 percent by weight poly(arylene sulfide) and 5 to 30 percent by weight polytetrafluoroethylene.

The slurry is applied to a substrate by spraying. The sprayed blend is cured in an oven at about 700°F. for a time sufficient for the polytetrafluoroethylene to come to the surface to produce a slick release surface. The poly(arylene sulfide) adheres to a metal base better than the polytetrafluoroethylene and is harder than polytetrafluoroethylene so that the resulting cured blended coating is a better combination of tough and slick than the component polymers could produce separately.

The coatings produced above have a gray coloration. To lighten the color, titanium dioxide can be added in an amount from 1 to 40 percent by weight of the total weight of polymeric material without affecting the coating strength or slickness appreciably. The most practical amount of colorant is in the range of 20 to 30 percent by weight of the total weight of polymeric material. The titanium dioxide is mixed thoroughly with the blend before spraying the substrate. The resulting coating has a light tan color.

Figure 2:
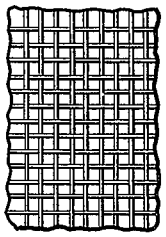
Figure 3:
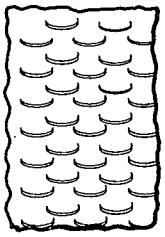
Figure 4:
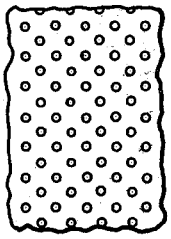

This invention can be best understood when described in conjunction with the drawings which illustrate in:

FIG. 1 a diagrammatic sketch of a solid separating system in which this invention is applicable, and FIGS. 2 through 4 types of coated screens which are among those suitable for use in the invention.

Referring now to FIG. 1, in a usual separating operation, drilling liquid containing mud and solid particle cuttings is circulated from the drilling operation through line 1 where it can be divided in appropriate amounts between smaller feed lines 2 and 3 to be fed into the distribution chambers 4 and 5 of a shaker apparatus 6 and 7. The distribution chambers distribute the flow of fluid drilling mud slurry with cuttings over the surface of a screen 8 and 9 which has openings of sufficient size to pass through the mud particles, drilling fluid, and small cuttings which are collected below the shaker screen and carried by lines 10 and 11 to a second set of screens 12 and 13 the larger cuttings are retained on the screen surface and discharged from the surface through lines 14 and 15. The screen openings can be of size appropriate to remove about 90 percent of the cuttings from the drilling mud.

The second set of drilling mud screens will be of much smaller size than the firt set so that the liquid conducted into the distribution chambers 16 and 17 will be passed through a series of screens 18 and 19 which may be of the same size, or can be of progressively smaller size openings as the fluid is passed down stream. Here the fluid is passed through the screens into lines 20 and 21 to be recirculated to the drilling operation while the gummy material passes across the screen surface with the cuttings. The screen opening sizes in the second set of shakers can be set so as much as 90 percent of the cuttings remaining from the first separation are removed in the second operation. These cuttings are removed through lines 22 and 23.

Since in the screening operations the screens having the smaller openings are more likely to be blinded by material bridging the openings and shutting them off, a by-pass line 24 and suitable valves 25 are usually provided to bypass the fluid flow away from the finer screen so that they can be cleaned.

The process of my invention is suitable for supplying coated screens both for gross separation illustrated in separating devices 6 and 7 and for the finer separation illustrated in devices 12 and 13.

As illustrated in FIGS. 2 through 4 screens made of woven metallic wire (FIG. 2), expanded metal (FIG. 3), or perforated metal plate (FIG. 4) can be coated with a suitable thickness of solid arylene sulfide polymerpolytetrafluoroethylene blend to obtain a coated screen suitable for use in this invention. This invention encompasses screen plates in which only the portion containing openings is coated and also screen plates in which the total plate including that portion having openings and any supporting structure surrounding the edges of the open work portion are coated.

As set out in FIG. 1 any of the screens used in the shaker apparatuses can be improved operationally by coating the screens with a "slick" polymeric substance so that gummy or sticky materials will be less likely to adhere to the screen surface. Of course, the smaller the openings through which the liquid is passed, the more effective is the coating as compared to an uncoated metal screen.

The following examples are set forth to show the operability of the invention. These examples should not be taken as limiting the scope of the invention.

EXAMPLE I

For an operational setup as shown in FIG. 1 screens coated with a cured blend of 94 percent by weight poly(arylene sulfide) and 6 percent polytetrafluoroethylene with 18 percent titanium dioxide based on total polymer weight added to the blend were supplied for a Milchem rotary vibrating shaker (R.V.S.) corresponding to shaker 12 in FIG. 1. For 30 × 30 mesh coated screens were installed on shale shaker 12. Four 40 × 40 mesh regular steel screens were installed on shaker 13. A double Rumba shaker 6 and 7 FIG. 1 with 14 × 14 mesh screens was run ahead of the R.V.S. shakers. The screens were run for ½ hour after installation, shut down and the correct amount of torque was applied to all bolts on both R.V.S. shakers. The shakers were restarted but part of the 26 barrels per minute of fluid being circulated had to be bypassed for 1 hour due to carboxymethyl cellulose clogging the screens on both R.V.S. shakers. After 1 hour, total fluid volume could be passed across the shakers.

Gumbo was encountered after 5 hours of drilling. The coated screens cleaned very well with no gumbo staying on the screens, while a noticeable amount of gumbo stuck to the steel screens. After 45 hours of drilling the **18*a* coated screen was showing considerable wear, screens 18*b* and 18*c* were like new, 18*d*** screen showed a small amount of wear in several places.

After drilling through the gumbo a soft shale section was encountered. Again the coated screens cleaned better than the regular screens. The cuttings moved down the coated shaker quicker and there was no build up of cuttings along the bottom of screen **18*d* on the coated shaker as there was on the regular shaker. After 54 hours running time coated screens 18*a* and 18*d* showed considerable wear; screens 18*b* and 18*c* were still all right. For the next 34 operating hours no new wear was evident. The formation being drilled was chalk. Also during this period 3 cones were lost in the hole and it was necessary to mill them up. During this 34 hours almost no solids were passed across the screens. After a total of 108 hours of operation no coating remained on coated screen 18*a*, 18*b* was badly worn on the top half where the fluid volume was heavy, 18*c* screen in good condition, 18*d* screen badly worn. After 125 hours of operation the coating was completely gone from screens 18*a* and 18*b*. No fluid was reaching screen 18*c* which still showed very little wear. Screen 18*d* was badly worn. It was necessary to remove screens 18*a* and 18*b* and two 50 × 50 mesh regular steel screens were installed. With the finer mesh screens fluid now covered all of 18*c* coated screen and the top of 18***d* screen. After 142 operating hours (17 hours after 50 × 50 screens were installed) coated screen 18*c* showed noticeable wear. Coating was completely worn off screen 18*d* in several places. Afteer 161 hours of operation no coating remained on 18*c* and 18*d* screens. They were replaced by two 40 × 40 mesh regular steel screens.

During the time that the coated screens were run the bulk of the cuttings were removed by the Rumba shakers so a large amount of cuttings was never circulated across the coating. The coating appeared to wear mainly due to fluid flow. During the period when the coating was worn off 18*c* screen a chalk formation was drilled. Almost no cuttings were coming across the screens and the few cuttings that did appear were not abrasive.

Although it appears that the coated screens were not highly resistant to wear, the example above shows the effectiveness of the coated screens as compared with regular metal screens in passing gummy material.

EXAMPLE II

In a similar operational setup shakers 6 and 7 as shown in FIG. 1 were Thompson shale shakers and shakers 12 and 13 were Milchem high-speed shale shakers. Two polytetrafluoroethylene coated mtal 16 gauge sheet steel screens with ¼ inch holes drilled 1 per square inch were placed in the two Thompson shale shakers which were upstream of the two Milchem high-speed shakers.

In operation clay did stick to the polytetrafluoroethylene coated steel screens, but the amount of clay sticking was reduced by 75 percent — one man could keep these screens clean compared to five men continually cleaning conventional screens of the shakers.

Reasonable variation and modification are possible within the scope of the foregoing disclosure, the drawing and the appended claims of the invention, the essence of which is that there has been provided a shaker screen coated with a polymeric material of sufficient "slickness" effectively to separate a drilling fluid and gummy particulate material while minimizing blinding and bridging of the openings of the screen.

I claim:

1. A metal substrate comprising openings to form a screen, said substrate coated with a cured blend comprising from about 99 to 25 percent by weight poly(arylene sulfide) and from about 1 to 75 percent by weight fluoroethylene.

2. A screen of claim 1 wherein said metal substrate is chosen from among perforated metal, expanded metal, and woven element screening.

3. A coated substrate of claim 1 wherein said coating also comprises from about 1 to 40 percent titanium dioxide by weight based on said blend weight added to said blend.

4. A method for separating drilling cuttings and gumbo from drilling fluid comprising:

1. passing said drilling fluid containing drilling cuttings and gumbo onto a screen, said screen comprising a metal substrate having openings to form a screen, said substrate coated with a cured blend of poly(arylene sulfide) and polytetrafluoroethylene;
2. passing said fluids through openings in said screen, said openings sized to retain solid particulate matter and gummy solids; and
3. retaining said solid particulate matter and said gummy solids on said screen.

5. A method of claim 4 wherein said cured blend of poly(arylene sulfide) and polytetrafluoroethylene also comprises from about 1 to 40 percent titanium dioxide by weight based on the weight of said blend.

6. A method of claim 4 wherein said coating blend comprises from about 99 to 25 percent by weight poly(arylene sulfide) and from about 1 to 75 percent by weight polytetrafluoroethylene.

* * * * *

UNITED STATES PATENT AND TRADEMARK OFFICE

CERTIFICATE OF CORRECTION

PATENT NO. : 3,963,605

DATED : June 15, 1976

INVENTOR(S) : Ed O. Seabourn

It is certified that error appears in the above-identified patent and that said Letters Patent are hereby corrected as shown below:

Column 6, line 10, "fluoroethylene" should be

---- polytetrafluoroethylene ----.

Signed and Sealed this

Fourteenth Day of September 1976

[SEAL]

*Attest:*

RUTH C. MASON
*Attesting Officer*

C. MARSHALL DANN
*Commissioner of Patents and Trademarks*